United States Patent [19]

Smith

[11] Patent Number: 4,543,721

[45] Date of Patent: Oct. 1, 1985

[54] MARTIAL ARTS WEAPON

[76] Inventor: Kenneth M. Smith, 1-B Malcolm Ct., New Haven, Conn. 06519

[21] Appl. No.: 606,161

[22] Filed: May 2, 1984

[51] Int. Cl.[4] ..... B26B 3/04; B26B 11/00

[52] U.S. Cl. ..... 30/287; 30/295; 30/299; 7/144

[58] Field of Search ..... 30/1, 287, 299, 303, 30/314, 294, 295; 7/144

[56] References Cited

U.S. PATENT DOCUMENTS

| | | | |
|---|---|---|---|
| 251,851 | 1/1882 | Emmenegger | 30/303 X |
| 449,031 | 3/1891 | Bernard | 30/295 |
| 817,717 | 4/1906 | Kottas | 30/299 X |
| 1,060,811 | 5/1913 | Bowers | 30/295 X |
| 2,441,475 | 5/1948 | Di Veglia | 30/299 |
| 3,710,407 | 1/1973 | Reid | 7/144 |

*Primary Examiner*—Jimmy C. Peters

*Attorney, Agent, or Firm*—Costas, Montgomery & Dorman

[57] ABSTRACT

A martial arts weapon having a multiplicity of blades and striking surfaces and further providing a trap for grasping a stabbing blade of an opponent.

5 Claims, 5 Drawing Figures

MARTIAL ARTS WEAPON

FIELD OF THE INVENTION

This invention relates to a weapon useful in the practice of the martial arts.

BACKGROUND OF THE INVENTION

Various special purpose weapons have been proposed for hand combat. An example is shown in U.S. Pat. No. 2,441,475, which discloses a weapon with a plurality of blades. Other patents such as U.S. Pat. Nos. 584,396 and DES 35,720 disclose multipurpose knives and tools having blades desposed of substantially ninety degrees to each other.

However, there is no known martial art weapons which will permit a multiplicity of maneuvers including stab, poke, club, rake, or slash and also be formed so as to permit defense against an opponent with a cutting or stabbing weapon.

SUMMARY OF THE INVENTION

The present invention provides a weapon having a central shaft with a handle at one end thereof and sharpened to a blade at the other end thereof with the handle being defined at the forward end by a handguard and at the rear end by an enlarged blunt knob useful for clubbing. The sharpened end is designed for straight stabbing. A member extends radially from the central shaft and curves arcuately therefrom and receives a detachable blade at the end thereof. The arcuate turn defines an elbow which may be used to deliver a striking blow, while the extending blade may be used for slashing or poking. A further conically shaped pointed member extends from the central shaft at an angle of substantially ninety degrees to the detachable blade which permits a sideways poking or stabbing stroke. The arrangement described further provides a structure which allows capture of an opponent's blade as hereinafter described. The blades and pointed member may be sheathed in a protective material for practice of the martial arts.

An object of this invention is to provide a new and improved martial arts weapon.

The features of the invention, which are believed to be novel, are particularly pointed out and distinctly claimed in the concluding portion of this specification. The invention, however, together with further objects and advantages thereof, may best be appreciated by reference to the following detailed description taken in conjunction with the drawings.

DETAILED DESCRIPTION OF THE ILLUSTRATED EMBODIMENTS

Figures 1, 2:
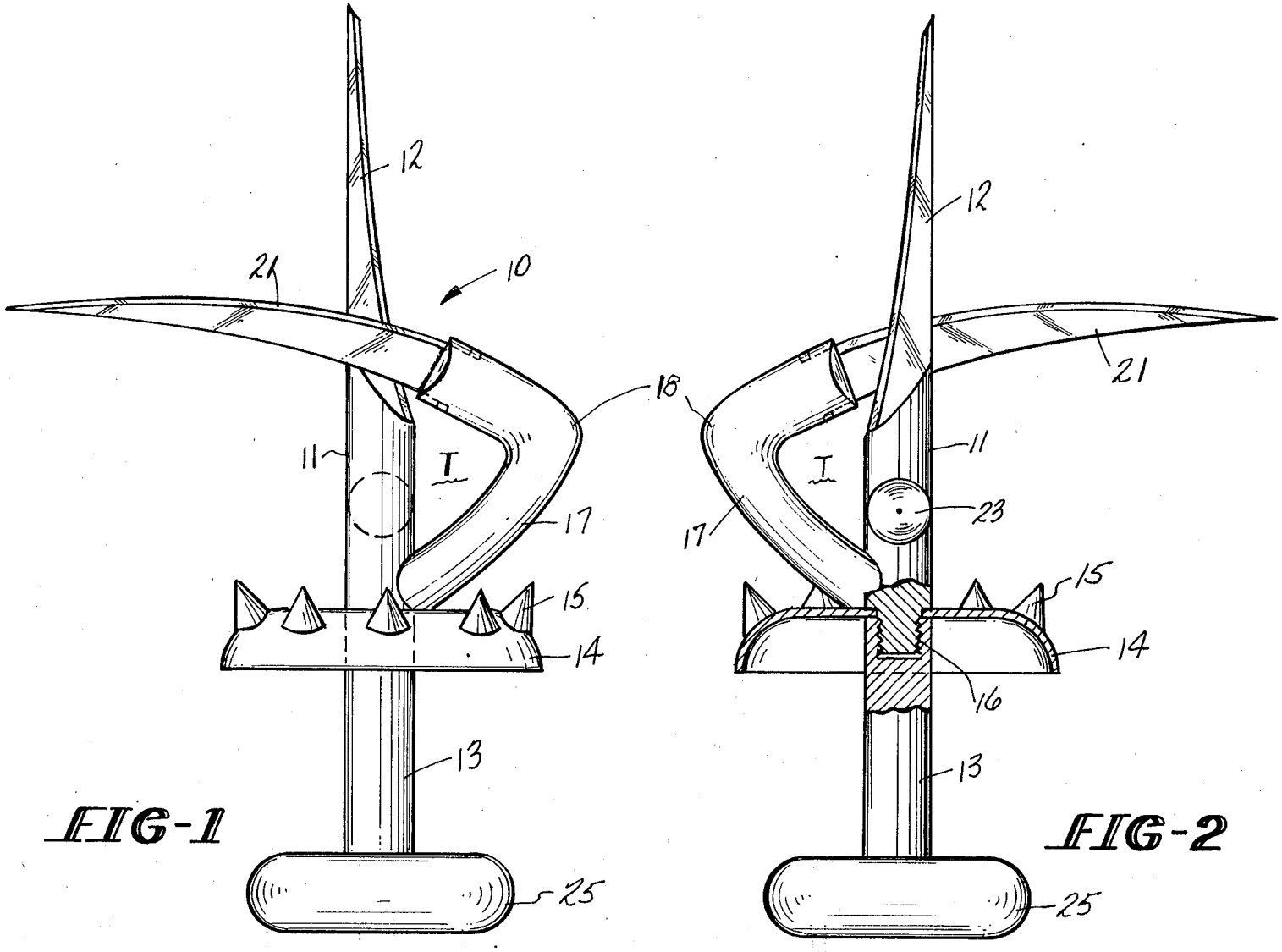
FIG. 1 side elevation of a weapon embodying the invention.
FIG. 2 is a view of the weapon of FIG. 1 rotated ninety degrees.

With reference to the drawings, a weapon 10 embodying the invention comprises a central shaft 11 which further comprises a forward blade portion 12 and a handle 13 separated by a handguard 14. Handguard 14 is of generally dished shape concave to handle 13. A plurality of projections 15 extend from the blade side of handguard 14 in an annular array about shaft 11.

As shown in FIG. 2, handguard 14 is secured to shaft 11 by being received between lands on shaft 11 and handle 13 surrounding a threaded coupling 16 between blade portion 12 and handle 13.

Figure 3:
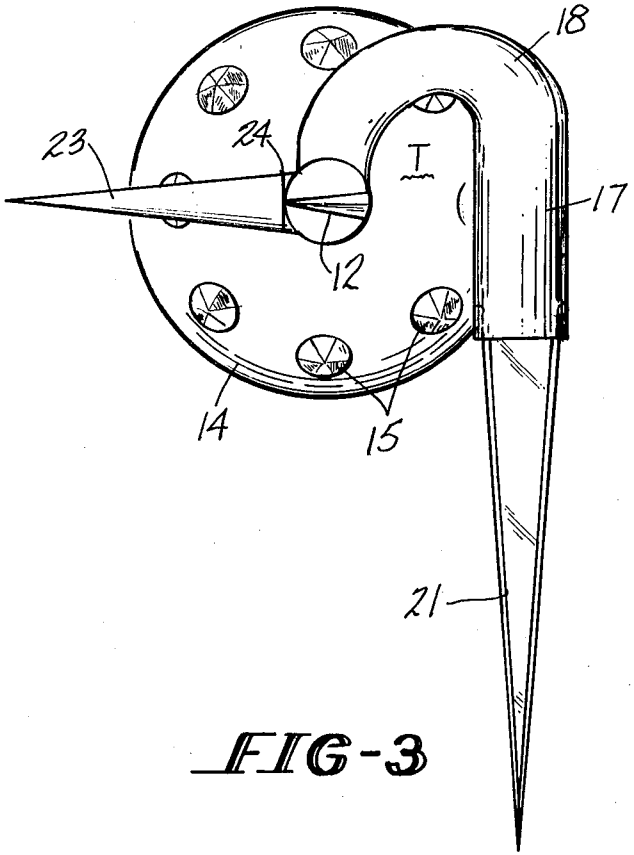
FIG. 3 is an end view of the weapon of FIG. 1 seen from the top of FIG. 1.
Figure 5:
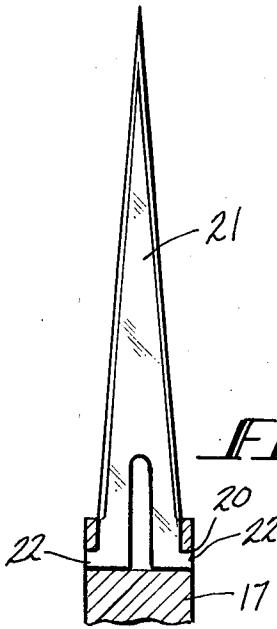
FIG. 5 is an isolated view showing the method of attachment of a blade to the weapon of FIGS. 1–4.

A member 17, preferably formed integrally with shaft 11 extends initially radially from shaft and turns approximately one hundred eighty degrees to shaft 11 to provide an elbow 18 which extends beyond the periphery of handguard 14, as shown in FIG. 3. Defined in the end of member 17 are detents 20 for a bayonet type coupling with a blade 21 as most clearly shown in FIG. 5. Blade 21 has projections 22 thereon which are received in detents 20.

As shown in FIG. 3, blade 21 extends substantially ninety degrees to shaft 11, but also extends forwardly from the point of junction of member 17 with shaft 11 as member 17 turns substantially one hundred eighty degrees.

Figure 4:
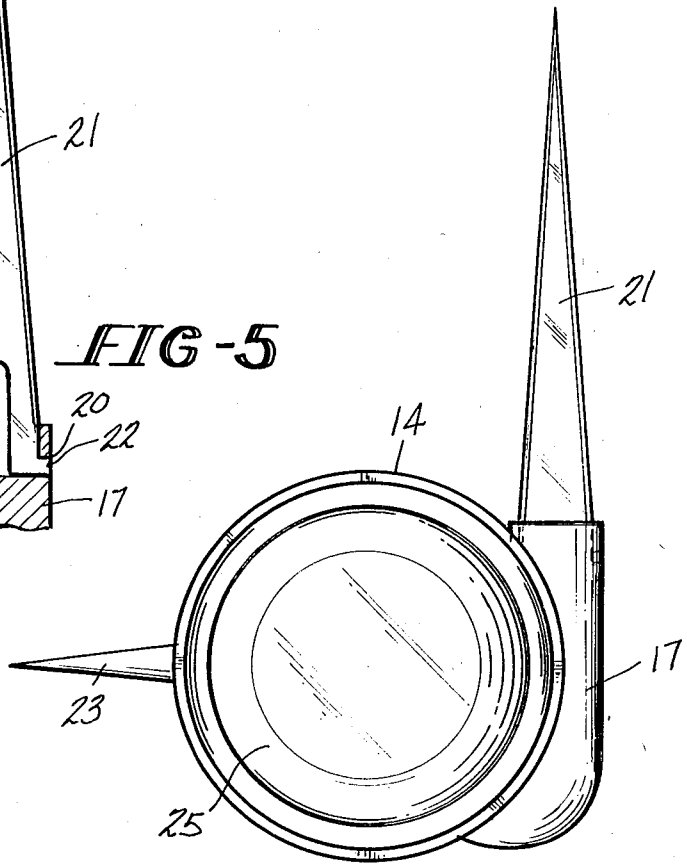
FIG. 4 is a view seen in the plane of lines 4—4 of FIG. 1.

Also extending from shaft 11 on the blade side of handguard 14 is a pointed member 23 of generally conical shape. Member 23 is disposed substantially ninety degrees to blade 21 an projects beyond the periphery of handguard 14 as shown to FIGS. 3 and 4.

Member 23 is preferably joined to central shaft 11 by being seated on a seat 24 on shaft 11. The seat 24 and member 11 are tapped to receive a stud (not shown) and thus joined. Handguard 14 may be formed with projections 15 thereon either by casting or forging. The central shaft 11 and handle 13 are preferably cast, then the end of shaft 11 is ground or otherwise worked to form blade 12.

Formed integrally with or attached to handle 13 is an enlarged terminal blunt knob 25.

For practice, the blades are sheathed with rubber or plastic. The member 17 defines with shaft 11 a trapping area T designed to permit the user to trap a blade of an opponent between member 17 and shaft 11. In this connection, the projections 15 serve to also engage the tip of an opponent's blade. Then by twisting the opponent's blade, it may be wrested from the opponent's hand.

The weapon 10 will normally be held with blade 12 extending horizontally and blade 21 pointing downwardly. In the hands of a right handed user, blade 21 may then be used for a slashing stroke in a generally vertical plane and elbow 18 used to deliver a blow when swung in a generally horizontal plane. The projection 23 may be used for poking in a generally backhand motion from left to right. The enlarged blunt knob may be used to deliver an overhand to sideways blow. The disclosed weapon provides a multiplicity of options for use.

It may thus be seen that the objects of the invention set forth above, as well as those made apparent from the preceding description, are efficiently attained. While preferred embodiments of the invention have been set forth for purposes of disclosure, other embodiments and modifications of the disclosed embodiments may occur to others skilled in the art. Accordingly, the appended claims are intended to cover all embodiments of the invention which do not depart from the spirit and scope of the invention.

What is claimed is:

1. A martial arts weapon comprising a central shaft having a handle portion extending linearly into an elongated sharpened blade, a handguard having an annular periphery intermediate said handle portion and said blade, a member extending from said shaft of the blade side of said shaft beyond said handguard and arcuately turning in a direction substantially perpendicular to said shaft, said arcuately turning member having a blade extending therefrom, a pointed member extending from said central shaft to a dimension beyond the periphery of said handguard, said pointed member being substantially perpendicular to the end of the blade on said arcuately extending member, said pointed member extending from said shaft between said handguard and the sharpened end of said central shaft.

2. The weapon of claim 1 where said central shaft and said arcuately turning member define a trap adapted to receive a blade of an opponent.

3. The weapon of claim 2 wherein said handguard has a plurality of projections thereon in an annular array about said central shaft.

4. The weapon of claim 1 further including an enlarged blunt terminal end on said handle.

5. The weapon of claim 1 where said arcuately turning member defines an elbow extending beyond the periphery of said handguard.

* * * * *